US006868871B2

(12) United States Patent
Johansson et al.

(10) Patent No.: US 6,868,871 B2
(45) Date of Patent: Mar. 22, 2005

(54) STOPPER MAGNET FOR A MEASURING YARN FEEDER

(75) Inventors: Birger Johansson, Ulricehamn (SE); Henrik Svensson, Boras (SE)

(73) Assignee: Iropa AG, Baar (CH)

( * ) Notice: Subject to any disclaimer, the term of this patent is extended or adjusted under 35 U.S.C. 154(b) by 0 days.

(21) Appl. No.: 10/479,389

(22) PCT Filed: May 29, 2002

(86) PCT No.: PCT/EP02/05943

§ 371 (c)(1),
(2), (4) Date: Jun. 14, 2004

(87) PCT Pub. No.: WO02/097177

PCT Pub. Date: Dec. 5, 2002

(65) Prior Publication Data

US 2004/0216498 A1 Nov. 4, 2004

(30) Foreign Application Priority Data

May 29, 2001 (SE) ..... 0101890

(51) Int. Cl.[7] ..... D03D 47/36
(52) U.S. Cl. ..... 139/452; 242/365.4
(58) Field of Search ..... 139/452, 455; 242/365.4; 335/255, 256, 258

(56) References Cited

U.S. PATENT DOCUMENTS 4,310,868 A 1/1982 Lillie et al.
4,439,700 A 3/1984 Menzel et al.
4,632,155 A * 12/1986 Maina ..... 139/452
5,016,681 A 5/1991 Ghiardo
5,133,388 A 7/1992 Tholander
5,247,419 A 9/1993 Grundmann
6,006,794 A * 12/1999 Covelli ..... 139/452
6,095,201 A * 8/2000 Zenoni et al. ..... 139/452

FOREIGN PATENT DOCUMENTS

DE 195 09 195 A1 9/1996

* cited by examiner

*Primary Examiner*—Danny Worrell
(74) *Attorney, Agent, or Firm*—Flynn, Thiel, Boutell & Tanis, P.C.

(57) ABSTRACT

A method for controlling the motion of a yarn stopper magnet in a measuring feeder for textile machines, preferably for weaving machines of the air-or waterjet-type. The stopper magnet has an armature connected to a yarn stopper element, which armature co-acts with at least one electromagnetic coil in order to achieve the desired motion of the stopper magnet. During an initial part of the motion of the stopper element, the electromagnetic coil is supplied with a voltage with an amplitude considerably exceeding the average level of the voltage during the remaining part of the motion, in order to achieve an optimally fast motion with a low input energy amount and thereby a low heat development, as well as low kinetic energy (speed) of the stopper element at the end of its motion.

13 Claims, 2 Drawing Sheets

STOPPER MAGNET FOR A MEASURING YARN FEEDER

FIELD OF THE INVENTION

The invention relates to a method for controlling the motion of a yarn stopper magnet in a measuring yarn feeder for a textile machine, and to a stopper magnet of a measuring yarn feeder.

BACKGROUND OF THE INVENTION

In a method of this type known from U.S. Pat. No. 5,016,681 the coils are supplied with a voltage which is essentially constant during the whole motion of the stopper element. The voltage is high in order to achieve short motion times, for example of the magnitude of 5 ms for a motion of the magnitude of 4 mm. After the motion and a bounce, if any, to/in any end position, the voltage is usually decreased to an essentially lower value so that a suitable holding force is achieved without any overheating (in the long run). It is also usual that the motion- and/or holding voltage is controlled in order to compensate for the temperature-dependence of the stopper magnet. This type of power supply causes several limitations when the motion times are very short. The inductance of the stopper magnet gives an electric time constant which can be of the same magnitude as the motion time. The current, and subsequently also the force in the stopper magnet, will then rise relatively slowly. The consequence of this will, on one hand, be a time loss before the motion starts and, on the other hand, also a slow acceleration with a further time loss in the beginning of the motion. Furthermore, the force of the stopper magnet is usually position-dependent. At a certain current the force increases, and thereby also the acceleration of the armature, essentially when the armature is approaching its end position. This will cause the final speed of the armature to be high, often in the magnitude of 4 m/s. A short motion time means a high supplied energy amount with a high temperature as a consequence. A short motion time means also a high final speed with a high load at the end position as a consequence. The end position dampers are furthermore usually of a material, the load capability of which decreases drastically at an increasing temperature.

In solutions according to the prior art, usually a mechanical spring was used to keep the stopper magnet in any of the end positions in a current-free state. On stopper magnets with only one coil, this spring was usually used also for the return motion of the stopper element. This design has disadvantages, because the spring will cause a risk for mechanical wear and a not-inessential decrease of the force which is available for the motion.

According to a method as known from U.S. Pat. No. 4,310,868, a solenoid equipped with a driver circuit is actuated for each of consecutive picking strokes by first supplying very high current, which current is maintained relatively high over the entire picking stroke of the armature. Since the time constant of the pick capacitor circuit, i.e. the value of a resistor times the value of a capacitor, is much greater than the time constant of the solenoid, the drive circuit will hold strong current much longer than needed to build up a strong current in the solenoid. The current is decisive for the transmitted force. There is relatively strong current, i.e. high force, even when the armature has reached the end position. As a further consequence of the time constant of the pick capacitor circuit increased voltage is supplied to the coil over the entire picking stroke of the armature.

It is an object of the present invention to achieve a short motion cycle of the stopper magnet with a low input energy amount and a relatively low final speed (kinetic energy), and to reduce the demand for control in order to compensate for the temperature dependence of the stopper magnet. Additionally, the risk for mechanical wear ought to be reduced while a sufficiently strong holding force ought to be maintained in the end position of the stopper magnet.

During the initial start part of the motion cycle of the stopper magnet, the electromagnetic coil is supplied with a voltage, which may be constant or may vary, which is considerably higher than the average voltage level during the remaining part of the motion cycle. Due to this increased voltage supplied in the initial start part of the motion cycle, the magnetic field in the coil builds up very quickly. Thus, the motion of the movable parts of the stopper magnet starts comparatively early. Moreover, due to the increased voltage in the initial start part of the motion cycle the accelerating force for the armature is very high at the beginning of the motion of the stopper magnet. This high acceleration further reduces time losses at the beginning of the motion cycle.

By providing a permanent magnet mounted to the yarn stopper element and soft iron magnetic material in a fixed part of the stopper magnet, a holding force is achieved for the yarn stopper element in the end position of the stopper magnet by the magnetic attraction between the permanent magnet and the soft iron magnetic material. The movable parts can be held in the end position of the stopper magnet without physical contact with the fixed parts, and, thus, without friction or wear. The stopper magnet can preferably be operated by the above-mentioned method for reducing the input energy amount and the final speed.

BRIEF DESCRIPTION OF THE DRAWINGS

In the following, preferred embodiments of the present invention will be described with reference to the drawings, in which.

Figure 2:
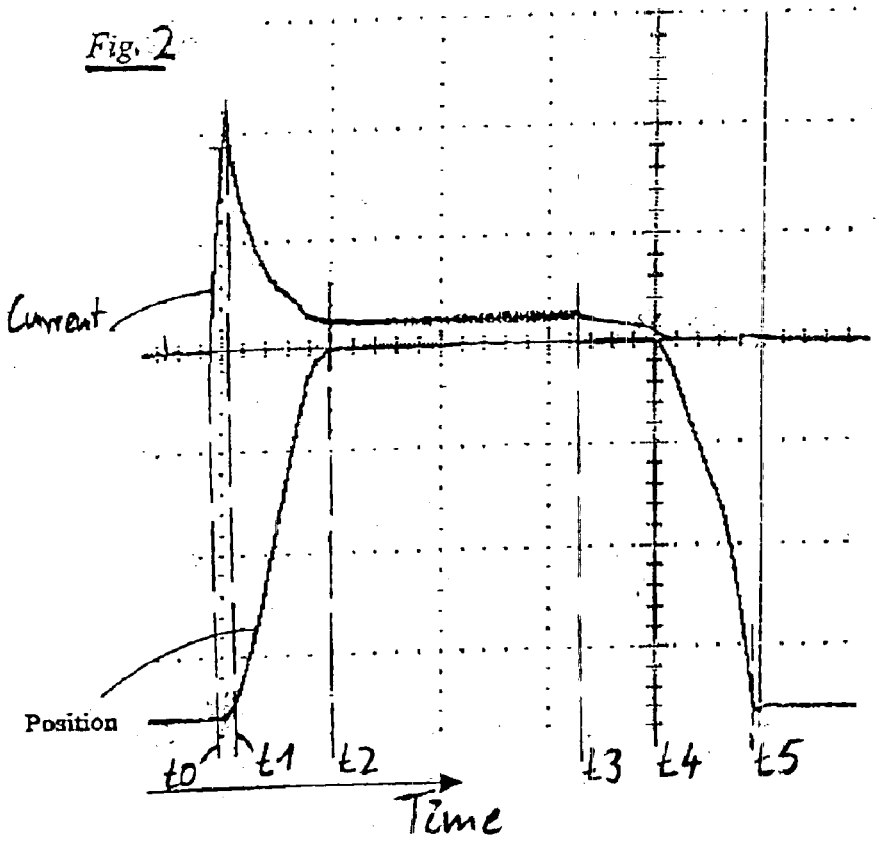
FIG. 2 is a diagram showing the current applied to the electromagnetic coils and the position of the stopper element over the time when operated in a first way according to the present invention.
Figure 3:
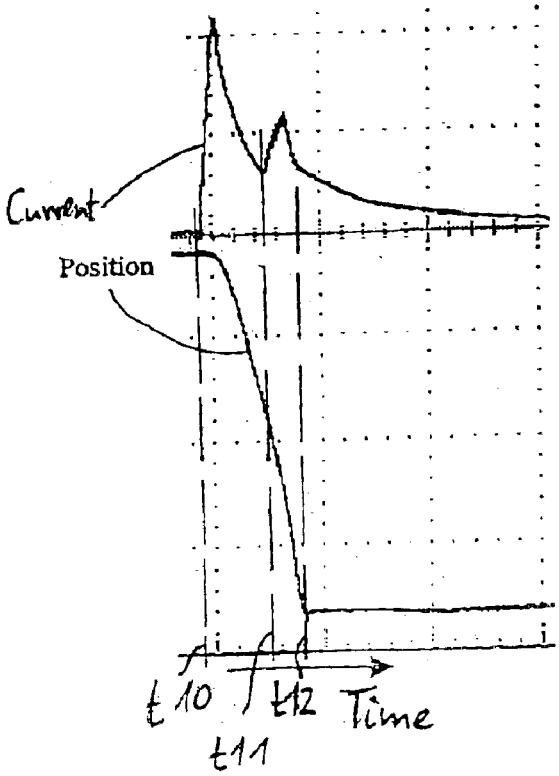
FIG. 3 shows a similar diagram as in FIG. 2 when the stopper magnet is operated in a second way according to the present invention.

The units of time, current and position in FIGS. 2 and 3 are arbitrary.

DETAILED DESCRIPTION

Figure 1:
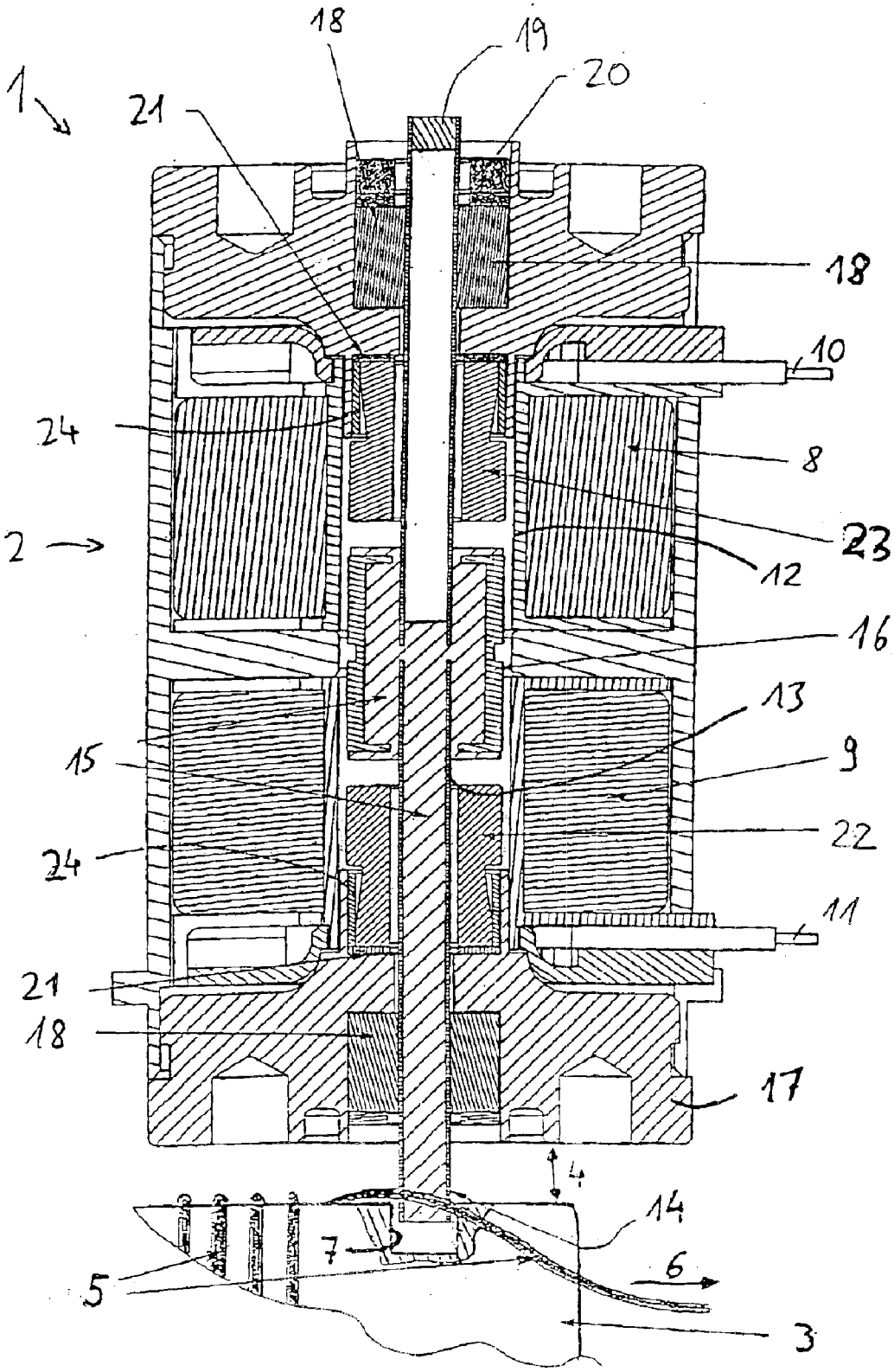
FIG. 1 shows a sectional view through a yarn stopper magnet according to the present invention.

FIG. 1 shows a preferred embodiment of a measuring yarn feeder 1 according to the present invention, comprising a stopper magnet 2. The stopper magnet 2 is spaced apart from a drum 3 of a yarn feeder by a gap 4. Yarn 5 is wound around the drum 3. In order to be fed to a textile machine, the yarn 5 is pulled off the drum 3 in a direction indicated by arrow 6.

In order to determine the length of yarn 5 being fed to the textile machine, the measuring yarn feeder comprises a measuring element (not shown) for detecting the number of windings of yarn 5 that have been pulled off the drum 3. After a predetermined number of windings have been pulled off, the pulling-off of yarn 5 is to be stopped. This is achieved by the stopper magnet 2 pushing its stopper element 13 forward through gap 4 and into a recess 7 in the drum 3. Further pulling-off of yarn 5 is prevented, since the yarn 5 engages the stopper element.

The stopper magnet 2 comprises two coaxial electromagnetic coils 8 and 9. These coils 8 and 9 can be operated independently from each other by applying a voltage via respective electrical connections 10 and 11.

On the axis of the electromagnetic coils 8 and 9, the stopper magnet 2 has a central aperture 12. In axial alignment with the coils 8 and 9, the stopper element 13 extends through the aperture 12. The stopper element 13 is moveable in an axial direction of the aperture 12. By this movement, the lower end of the stopper element 13, which is the so-called stopper pin 14, can be brought into engagement with the recess 7 in drum 3 or retracted therefrom.

In the embodiment shown in FIG. 1, the stopper element 13 is designed as a metal tube that is at least partly filled with a plastic 15, for example polyurethane. This serves to reduce the mass of the stopper element 13 in comparison with other embodiments in which the stopper element 13 is made of a solid metal rod, for example of steel.

The central portion of the stopper element 13 is surrounded by an armature 16. The armature 16 is made of magnetic or magnetizable material, for example soft-magnetic iron. In this embodiment the armature 16 is formed as a shell, which are bound together and to the stopper element 13 by the polyurethane filling 15.

The stopper element 13 is guided in an outer casing 17 of the stopper magnet 2 by two cylindrical bearings 18.

A permanent magnet 19 is mounted on an end portion of the stopper element 13, which is the end portion opposite to the stopper pin 14. In proximity to the location of this permanent magnet 19, a member 20 of soft-magnetic iron is placed in the fixed part of the stopper magnet 2. This member 20 of magnetisable material may be either one piece, for example ring-like, or formed in several separate parts. It could also be provided in the form of adaption of any of the existing fixed parts of the stopper magnet 2. The aim of this design is to achieve a wear-free end position holding for the stopper element 13 with a desirable value and characteristic of the holding force. This is achieved by the magnetic attraction between the permanent magnet 19 and the member 20 of soft-magnetic iron when the stopper element 13 reaches its extended end position.

As another important advantage, the magnetic attraction between the permanent magnet 19 of the stopper element 13 and the magnetisable member 20 provides sufficient force to hold the stopper element 13 in its locking position even in the case of a current break.

On the top and bottom end of the aperture 12, dampers 21 are provided in order to reduce undesirable bouncing of the stopper element 13 in its locking position. The dampers 21 are of a material which, in this connection, can be considered as resilient and energy-absorbing, for example polyurethane.

Adjacent each damper 21, a counter-mass 22, 23 is provided within the aperture 12. Each counter-mass 22, 23 is shaped as a hollow cylinder, receiving the stopper element 13 in its central throughhole. Holding brackets 24 keep the counter-masses 22, 23 in their positions in proximity to the dampers 21, but they leave the counter-masses 22, 23 free to move slightly in an axial direction in the aperture 12.

The mass of each counter-mass 22, 23 is of the same magnitude as the total mass of the movable parts of the stopper magnet 2, i.e. as the sum of the masses of the stopper element 13, the armature 16 and the permanent magnet 19. When these moveable parts reach one of their end positions, an end of the armature 16 collides with an end portion of the respective counter-mass 22, 23. Being of the same mass as the moveable parts, the counter mass 22, 23 absorbs the complete momentum (m times v) of the moveable parts, thereby in the ideal case immediately stopping the moveable parts without bouncing. Being accelerated by the impact, the counter-mass 22, 23 travels towards the damper 21, being slowed down by the latter. When the counter-mass 22, 23 returns to the stopped armature 16 due to the elastic properties of the damper 21, it has already lost most of its kinetic energy and is unable to move the armature 16 and the stopper element 13 out of their position.

The counter-masses 22, 23 are made of a hard, inelastic material; preferably magnetisable or soft-magnetic machine steel is used. These magnetic properties enable the counter-masses 22, 23 to perform a second function: being located at least partly within the electro-magnetic coils 8, 9, the magnetisable counter-masses 22, 23 can serve as the yokes of the coils 8, 9. Thus, they increase the magnetic field at the armature 16.

In the following, a method for controlling the motion of a yarn stopper magnet 2 in a measuring yarn feeder according to the present invention is described. This method may preferably be used in a stopper magnet 2 as described with respect to FIG. 1, but it may also be employed in alternative stopper magnets, for example with only one electromagnetic coil. According to this method, the coil/coils 8, 9 is/are supplied during a part of the motion time with a voltage, constant or varying, which is essentially higher, at least twice as high as what has been the case in known solutions according to the state of the art. In particular, this increased voltage has an amplitude considerably exceeding the average voltage level during the remaining part of the motion. The increased voltage may, for example, be applied in the start-"moment", i.e. when the stopper element 13 is supposed to begin its motion. In FIG. 2, this time is designated by $t_0$.

From FIG. 2 it is to be seen that this high voltage ("via the system inductance") will generate a current-"spike" which is essentially higher than the average level of the control current during the remaining part of the motion cycle (the approximately horizontal part of the graph in Fig. 2). By start-"moment" in this case is meant a time which for example may have a duration of appr. 1 ms. It starts when the motion process shall start ($t_0$), the time is, on one hand, smaller, preferably essentially smaller, than the whole motion time and, on the other hand, it is not essentially greater than the electric time constant of the stopper magnet. Thereafter, i.e. after for example said 1 ms ($t_1$), the voltage is controlled, analogously according to a function that may be chosen or in one or several selectable steps, so that a suitable current, and thereby also a suitable force is generated along the motion and at the end position. An example of a motion and a current characteristic is, as has been said earlier, shown in FIG. 2. Compared with solutions known so far, the method according to the present application will give an essentially lower final speed (lower kinetic energy) of the stopper element, provided the motion time ($t_{0\ -t2}$) is the same. The consequence will be lower load on the end position which the stopper element 13 has reached at the time $t_2$. Furthermore, the method will, compared with the prior art, give a lower input of energy amount with a lower temperature as a consequence.

Compared to the prior art, a comparatively greater part of the working cycle of the stopper magnet 2 will be mainly inductive. The consequence will be that the influence of the resistance, and thereby also the temperature variation of the resistance, will be reduced.

The measuring yarn feeder 1 may, for example, be driven by applying an AC voltage of 220 V in the main line. This AC voltage is rectified, yielding a DC voltage with a value of approximately 300 V. A voltage with a value of approximately 300 V could then be used as the increased voltage, while the average voltage applied to the coils 8, 9 has a value in the range between approximately 50 and 150 V. Although the coils are designed to receive only the average voltage, they will not be adversely affected by the voltage increase due to the very short duration of the voltage increase. Moreover, in comparison with prior art techniques, the total amount of applied energy and, accordingly, the total amount of heat induced in the coils is lower. Thus, the risk of over-heating the coils is further reduced.

In a different embodiment, the stopper magnet 2 is driven by a generator supplying a voltage of 48 V. In this case, the total voltage of 48 V would be used as the value of the increased voltage, while the average voltage in the remaining part of the motion would have a value between 15 and 25 V, for example.

The following variant/modification of the invention can further reduce the input energy amount and the final speed. The variant can be used in combination with the embodiment mentioned above, or separately:

In certain cases of operation, there can exist information in advance in connection with the stopper magnet 2, i.e. "before-hand", about when a motion cycle shall start. Then, the holding current in the end position where the armature 16 is then situated, can be reduced considerably or be completely shut off just before the start-"moment" $t_4$. By "just before the start-moment" in this case is meant a time that ends when the start-"moment" is beginning. The time shall be at least so long that a considerable reduction of the holding current can be achieved; the time shall, however, not be so long that the motion can start too early, for example due to gravity or other forces in the system. The variant gives, in the start-"moment" $t_4$ a reduction of the holding force that must be overcome in order that the motion shall be able to start. The consequence will be that the motion will start earlier.

In FIG. 2, this method of operation is shown for the return motion of the stopper element 13. This return motion is supposed to begin at a time $t_4$. From an earlier time $t_3$ onwards, the holding current in the end position is reduced such that the holding current has a value of 0 at the time $t_4$ or slightly later. This enables the stopper element 13 to start its motion exactly at $t_4$. At a later time $t_5$, the stopper element 13 has reached its original position again.

In yarn stopper magnets according to the state of the art there is usually a force close to the end position that is strong, in many cases stronger than desirable. This means that the requirements of the damping capability of the end positions are small.

In the new method described above for reduction of input energy amount and final speed (kinetic energy) of the stopper element 13, the voltage is controlled, and thereby also the force, to a desirable level. With the object, on one hand to minimize the amount of input energy, and on the other hand, to minimize the final speed, the voltage is held on the smallest possible level at the end of the motion. This will mean, compared with the prior art, that the force that is available for bounce damping in the end position will decrease. Two dampers and an inter-mediate counter-mass in each end position, for example according to FIG. 1, will give good results. A low current at the end of the motion can be achieved with a small bounce being kept.

An even more sophisticated method for controlling the motion of the stopper magnet 2 is shown in FIG. 3. It aims particularly at compensating for deviations in the motion time.

In the prior art, there is no compensation for deviations in motion time that depend on variations in load or friction. There is compensation for temperature dependence, but this will make a feed-back and a temperature sensor necessary.

The present jinvention also aims at proposing a new method for achieving, without sensors or feed-back, compensation for deviations in motion time.

Shortly before the nominal arrival-"moment" $t_{12}$ of the stopper element 13 (i.e. the calculated arrival time with negligible friction in case of only one voltage increase), a second voltage increase is provided, constant or varying (which "via the system inductance" results in the second, lower current-"spike" in FIG. 3). This voltage increase is essentially higher as compared with the corresponding voltage in the prior art or the corresponding voltage in the same phase in the control process according to FIG. 2, but it is preferably smaller than the first voltage increase. By "nominal arrival-moment $t_{12}$" in this case is meant a time that for example can have a duration of appr. 2 ms. It starts ($t_{11}$) in close proximity to the time when the movable part or parts hit(s) the end position at the end of a motion without deviation in motion time. The time is, on one hand, shorter than the motion time and further not essentially greater than the electric time constant of the stopper magnet 2. Hereafter, the voltage is controlled, analogously according to a chosen curve or in one or several selectable steps, so that a suitable current, and thereby also force, will be obtained in the end position.

In a comparison with the FIG. 2 method, this method will give a certain increase of input energy amount. For a motion without deviation in motion time, the final speed, and thereby also the load on the end position, will be only marginally influenced. For a motion with a deviation, for example caused by an increased load or friction, the supply of the second voltage increase does have an influence, since it compensates at least for a part of the time losses. Therefore, it is possible to operate the stopper magnet 2 according to a method in which a second voltage increase as shown in FIG. 3 is always applied, irrespective of the actual load or friction. This makes the design and operation of the stopper magnet 2 very simple and reliable, since there is no need for sensors in order to determine whether a second voltage increase should be applied or not.

The requirements on the damping capability of the end positions are reduced since the force that is available for bounce damping in the end position is increasing. The motion time for a motion can deviate upwardly for many reasons, lower input voltage to the control system, increased load or increased friction, to mention some of them. When this occurs, the voltage increase in the nominal arrival moment will cause a speed increase at the end of the motion. The speed increase counter-acts the time increase, but the final speed becomes essentially the same or lower as compared with a normal motion. The consequence will be a system that, without feedback or sensors and without increasing the load on the end positions, will compensate for a great part of the deviations that normally occur in the motion time. Examples of motion and current are, as said earlier, shown in FIG. 3.

The solutions in question are not restricted only to one stopper magnet with two coils. They are also applicable in the case of a forward motion of the soft iron armature with the stopper element by means of one electromagnet coil and a return motion by means of for example one return spring.

In relation to the invention, (electric) voltage means preferably either DC voltage or the RMS value of a modulated voltage, e.g. PWM technology.

What is claimed is:

1. Method for controlling the motion cycle of a yarn stopper magnet in a measuring yarn feeder for textile machines, the stopper magnet having an armature connected to a yarn stopper element, which armature co-acts with at least one electromagnetic coil for achieving the desired motion cycle of the yarn stopper element at least from an initial start position at a first point in time to an end position reached at a second point in time, wherein during at least an initial part of the motion cycle the electromagnetic coil is supplied with an increased voltage with an amplitude considerably exceeding the average voltage level amplitude during the remaining part of the motion cycle and for a duration not essentially greater than an electric time constant part of the stopper magnet.

2. Method according to claim 1, wherein the increased voltage exceeds the average voltage level during the remaining of the motion cycle by at least 100%.

3. Method according to claim 1, wherein the initial part of the motion cycle has a duration of approximately 1 millisecond (ms).

4. Method according to claim 1, wherein after the initial part of the motion cycle and in close proximity to a nominal point in time corresponding to the end position of the yarn stopper element, a second increased voltage is supplied to the electromagnetic coil, the second increased voltage being smaller than the first increased voltage, and the second increased voltage being supplied for a duration not essentially greater than the electric time constant of the stopper magnet.

5. Method according to claim 1, wherein the increased voltage is controlled to drop according to a predetermined curve or in one or several predetermined steps to the average voltage level amplitude.

6. Method according to claim 1, wherein a holding current for holding the armature and the yarn stopper element in the end position is reduced considerably or is shut off completely just before starting a return motion of the yarn stopper element .

7. Method as in claim 1, wherein a holding force is generated in the end position of the yarn stopper element by a permanent magnet mounted to the yarn stopper element co-acting with soft-iron material mounted to a fixed part of the stopper magnet.

8. Stopper magnet for a measuring yarn feeder for textile machines, and for carrying out the method according to claim 1, the stopper magnet having an armature connected to a yarn stopper element, which armature co-acts with at least one electromagnetic coil for achieving a desired motion cycle of the yarn stopper element at least from an initial start position to an end position, wherein the electromagnetic coil is connected with a DC-voltage source supplying maximally approximately 300 volts or with a voltage generator supplying maximally approximately 48 volts and is designed for an average long duration voltage level amplitude in the range between approximately 5 V to 150 V or 15 V to 25 V, respectively, and a permanent magnet is mounted to the yarn stopper element for yarn providing a holding force in the end position of the yarn stopper element in cooperation with a member of soft-magnetic iron placed in a fixed part of the stopper magnet.

9. Stopper magnet according to claim 8, wherein at least one counter-mass, of soft magnetizable or soft-magnetic machine steel is axially movably located at least partly within the electromagnetic coil in an aperture of the stopper magnet for mechanical co-action with the armature, wherein the counter-mass is loosely kept in position in proximity to a resilient damper, and wherein the counter-mass has a mass of the same magnitude as the sum of the masses of the armature, the yarn stopper element and the permanent magnet.

10. Stopper magnet as in claim 8, wherein the yarn stopper element is a metal tube at least partially filled with plastic material, and wherein the armature is formed as a shell made of magnetizable or magnetic material and is attached to the yarn stopper element by a filling of plastic material provided in the shell.

11. Method according to claim 1, wherein the increased voltage exceeds the average voltage level during the remaining part of the motion cycle by at least 300%.

12. Method according to claim 4, wherein the second increased voltage is supplied for a duration of approximately 2 milliseconds (ms).

13. Method according to claim 12, wherein the second increased voltage is controlled to drop according to a predetermined curve or in one or several predetermined steps to the average voltage level amplitude.

* * * * *